United States Patent [19]

Fletcher

[11] Patent Number: 5,046,925

[45] Date of Patent: Sep. 10, 1991

[54] GAS PISTON LIQUID FLOW CONTROLLER

[75] Inventor: Robert E. Fletcher, Vista, Calif.

[73] Assignee: Air Products and Chemicals, Inc., Allentown, Pa.

[21] Appl. No.: 638,714

[22] Filed: Jan. 8, 1991

Related U.S. Application Data

[63] Continuation-in-part of Ser. No. 452,901, Dec. 19, 1989, abandoned.

[51] Int. Cl.[5] ..... F04F 1/06

[52] U.S. Cl. ..... 417/138; 250/577; 73/223

[58] Field of Search ..... 250/577; 73/223, 293; 417/137, 138, 149

[56] References Cited

U.S. PATENT DOCUMENTS

| | | | |
|---|---|---|---|
| 2,505,905 | 5/1950 | McAfee | 73/223 |
| 3,384,885 | 5/1968 | Forbush | 250/577 X |
| 4,439,110 | 3/1984 | Massaux | 417/138 X |
| 4,440,022 | 4/1984 | Masom | 250/577 X |
| 4,530,465 | 7/1985 | Gauchet et al. | 73/223 X |
| 4,606,703 | 8/1986 | Baines | 417/138 X |
| 4,669,308 | 6/1987 | Jorritsma | 73/223 |

OTHER PUBLICATIONS

H. J. Albert & R. H. Wood; High Pressure, Thermal-Pulse, Liquid Flow Meter, 1985 American Institute of Physics.

T. E. Miller, Jr. & H. Small, Thermal Pulse Time-of-Flight Liquid Meter, Analytical Chemistry, vol. 54, May 1982, pp. 907-910.

1982 Chemical Processing Vaaler Guard-Moving Parts Eliminated in Thermal Pulse Flowmeter.

Thermal Pulse TM Flow Meter-Description Molytek, Inc., Pittsburgh, Pa., 2 pages.

Model 1002 Micro-Jector Syringe Drive Houston Atlas, Inc., Houston, Tex., 2 pages.

*Primary Examiner*—John C. Fox

*Attorney, Agent, or Firm*—James C. Simmons; William F. Marsh

[57] ABSTRACT

A gas piston liquid flow controller comprising a pumping chamber of fixed volume, means to separately introduce into said chamber pressurized gas and liquid, means to detect the presence of liquid at predetermined upper and lower levels in said chamber, means to withdraw a stream of liquid from said chamber for delivery to a point of use and a controller to maintain liquid in said chamber to effect constant delivery of liquid to the point of use.

6 Claims, 1 Drawing Sheet

GAS PISTON LIQUID FLOW CONTROLLER

This application is a continuation-in-part of U.S. patent application Ser. No. 07/452,901 filed Dec. 19, 1989, now abandoned.

FIELD OF THE INVENTION

The present invention relates to the handling of ultra pure and/or highly reactive reagents and, specifically, to methods and apparatus for controlling the flow of such reagents in a conduit system, with particular application to the control of the in-flow of such reagents into a chemical reactor in which the reagent is used. A particular example of such a reactor is a semiconductor processing furnace; however, the invention is of general applicability where it is import to maintain a reagent in a state of high purity and/or avoid contracting reactive materials with the reagent.

BACKGROUND OF THE INVENTION.

It is of very great importance in the manufacture of semiconductor devices, and in other chemical process operations, to control and/or measure the rate of inflow of a reagent into a chemical reactor. In the semiconductor industry, the common practice is to place silicon wafers supported in specially designed holders in a vacuum furnace, heat the wafers and, in successive operations, inflow into the furnace a reagent or a mixture of reagents at very precisely controlled mass flow rates where the reagent(s) react with the wafers or portions of the wafer and form alloys, coatings, or interstitial silicon compounds on the wafer surface. Such operations are described in considerable detail in Wolf, S. and Tauber, R. N. SILICON PROCESSING FOR THE VLSI ERA, Lattice Press, Sunset Beach, Calif. (1987). Other processes to which this invention is applicable are described by Considine, D. M., (Ed.), CHEMICAL AND PROCESS TECHNOLOGY ENCYCLOPEDIA, McGraw-Hill, New York, N.Y. and in many other encyclopedic works and in technical journals such as Chemical Engineering and the numerous trade journals which relate to the semiconductor trade and to other chemical process industries.

A number of methods and apparatuses for controlling reagents have been described. One of such instruments which has gained wide acceptance is the M-DOT® mass flow controller manufactured by the J. C. Schumacher Company, Oceanside, Calif. Other flow controllers include a micro-syringe drive controller sold by Houston Atlas, Inc. Houston, Tex. which is a mechanical system in which the liquid is pumped by a micro-syringe, and a thermal pulse device in which a heat pulse is imparted to the liquid, one form of which is sold by Molytek, Inc. Pittsburgh, Pa. See also, Albert, H. J. and Wood, R. J., Rev. Sci. Instrum. 56(10), Oct. 1985, and Miller, T. E. Jr. and Small, H., Analytical Chemistry 1982, 54.907, which describe thermal pulse and time of flight devices.

SUMMARY OF THE INVENTION

The valve of the present invention is directed toward improved flow controller in which the rate of flow is measured and/or controlled by measuring and controlling a precisely known absolute volume, but without the need for contacting the reagent with pistons and other mechanical drive devices.

The present invention embodies to a method and apparatus for controlling the flow of a liquid into a processing apparatus such as a silicon wafer furnace. The apparatus of the invention comprises a pumping chamber, the absolute volume of which is known and/or can be precisely determined, a pumping system or means for controllably pumping or introducing a liquid into the pumping chamber, a system or means for withdrawing a stream of liquid from the pumping chamber and a system for measuring and/or controlling the rate of pumping (flow) by controlling the flow of liquid into said chamber to maintain liquid in the chamber while the liquid is being withdrawn from the chamber.

In one preferred embodiment, the invention is a gas piston liquid flow controller which comprises a pumping chamber and means in the pumping chamber defining a phase interface surface at the Brewster angle. A light source for emitting light against the interface and means are provided for measuring the light reflected from the phase interface surface. The measured light, at two or more levels of liquid in the pumping chamber, generates a signal which is a function of the rate of pumping and which may be used to indicate and/or control the rate of flow of liquid and, hence, the flow rate of liquid to the point of use.

Controlling the pumping or flow rate of liquid in the carrier gas is effected by controlling the flow of gas (gaseous fluid) into the pumping chamber, the gas providing the driving force for forcing the liquid out of the pumping chamber to the point of use and permitting liquid reagent inflow into the pumping chamber.

DESCRIPTION OF THE PREFERRED EMBODIMENT

In the following discussion, reference is made to particular devices and arrangements, in order to provide a comprehensive description of the current preferred embodiment, and with the understanding that any combination of devices which functions in the manner described and which accomplished the purpose of the invention may be used within the scope of the invention.

Figure 1:
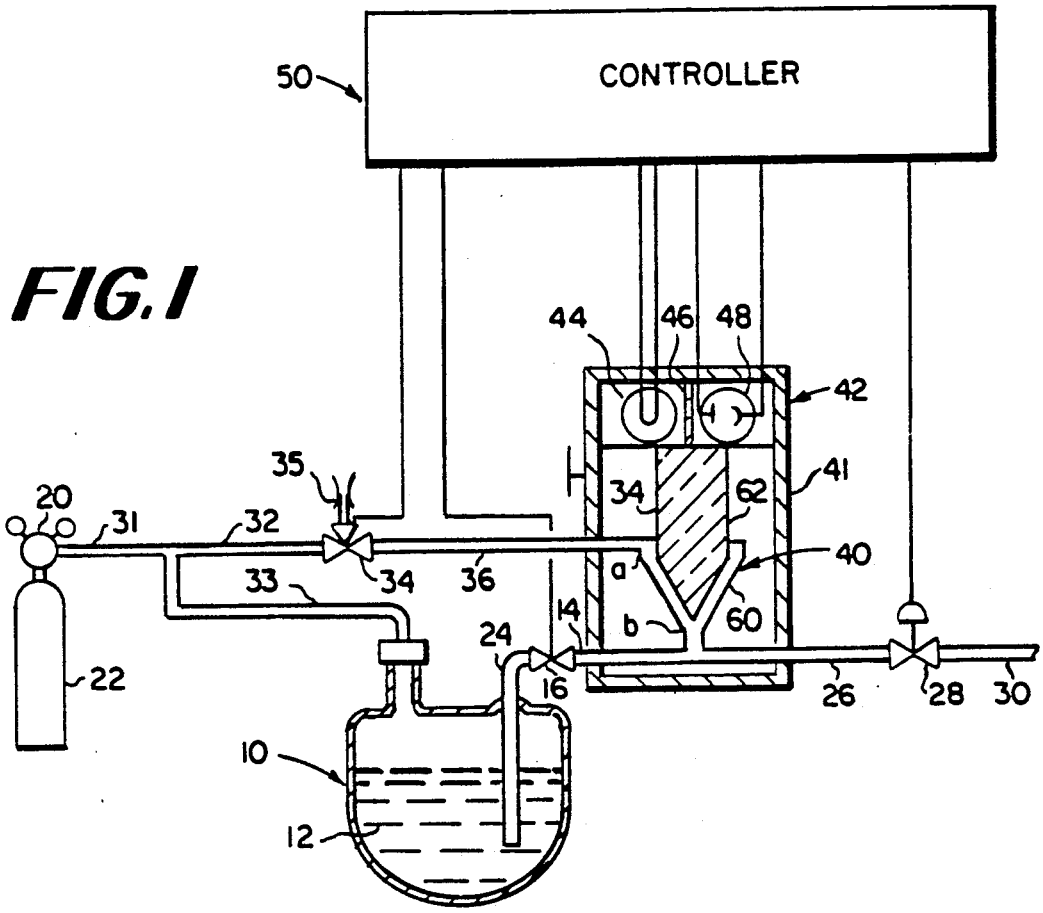
FIG. 1 depicts an exemplary form of the apparatus and system of the present invention in schematic form, the pumping chamber and reagent reservoir being shown in cross-section.

Referring now to FIG. 1, the basic nature of the components and the relationship of the components in an exemplary, schematically depicted system will be described, with the caveat that it is the functional relationship of the components to which the invention is directed and that any of a virtually infinite variety of types of components may be used to accomplish the purposes of the invention.

A typical system to which the present invention is applicable will involve a reagent reservoir 10 containing a liquid reagent 12 such as Tetramethyl Orthosilicate or TEOS as it is called in the trade for use in the deposition of a film during the manufacture of semi-conductors. The reservoir 10 has an inlet conduit 33 connected through cylinder regulator 20 to a source of pumping or high pressure; gas such as nitrogen, helium or other carrier gases used in the manufacture of semiconductors or electronic devices contained in cylinder 22. Reservoir 10 has an outlet conduit 24 connected, through control valve 16 and conduit 14, to a pumping chamber 40 and in turn is in fluid communication, through a conduit 26 with a metering or throttle valve 28 and then through a conduit 30 to the furnace or other reacting appliance, which is not part of the invention and therefore not shown for delivering reagent carried by the gas to the surface to be treated. The metering or control valve 28 controls flow from the pumping chamber 40 providing a predetermined flow of liquid. The liquid input and output conduits 14, 26 may be interconnected, as depicted, or separate.

High pressure gas from the source (e.g. cylinder 22) is regulated to the desired source pressure by regulator 20 and then delivered to reservoir 10 pressurizing liquid 12 for delivery through conduit 24, valve 16 and conduit 14 to chamber 40.

High pressure gas is introduced through a suitable conduit 32 to pressure regulating device such as valve 34 and then via conduit 36 to the chamber 40.

The pumping chamber 40 is provided with a level detection system 42 which in one embodiment may take the form of pumping chamber 40 enclosed in a light-proof housing 41, which may also include temperature controlling means (not shown), along with a light source such as an electric bulb, light emitting diode, etc. indicated at 44 and, separated by a light-proof barrier 46, a light measuring device such as photoelectric cell 48. Any light source for directing a beam of light toward the phase interface surface may be used. It is convenient to provide a light bulb 44 which has associated with it a polarizing filter. Any polarizer may be used but it is convenient to use the Land type (E. H. Land, 1928) polaroid sheet polarizer. These are sheets of plastic in which are embedded microcrystals of a dichroic material, such as quinine iodosulfate, that are aligned as the viscous plastic is extruded through a slit. Other forms of sheet polarizers similarly depend on a uniform molecular alignment. These are widely used in many optical instruments. It is not necessary to use polarized light; however, greater precision can be obtained using polarized light as a source and the following discussion will, for convenience, assume the use of polarized light. The light source, which is shown schematically, also includes a collimator or inherently emits collimated light in the direction of the end of the brewster prism 44 at the Brewster angle with respect to such end, as described in more detail hereinafter.

The flow controller of the present invention includes as its basic components, pumping chamber 40, valves 16 and 34 and 28 and the associated conduits together with the level detector 42 as hereinabove described are, in a convenient embodiment, interconnected through a controller depicted generally at 50. The controller 50 will generally include means for adjusting the valves 16, 28 and 34 in response to a signal generated by the liquid level detector 42 to control flow of liquid to the point of use through conduit 30. Valves 16, 28 and 34 can be simple electro-mechanical valves with associated electrical or electronic valve controllers of the type widely used in industry.

Figure 2:
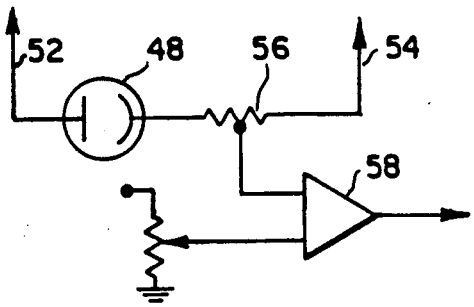
FIG. 2 is a simple circuit which may be used to product an electrical signal from a light detector.

The liquid level detector 42 in one embodiment of the invention includes a measuring device as part of a signal generating means one simple form of which is depicted schematically in FIG. 2. Simply as an example of any of the many signal generating means, FIG. 2 assumes a conventional photoelectric sensing device in which the resistance to current flow from the cathode to the anode is a function of the intensity (number or photons) striking the device. Conventional vacuum tube photoelectric cells or solid state photoelectric devices may be used. The photoelectric device 48 is connected to a voltage differential through electrical conductors 52 and 54 along with, in the example, a series voltage dropping resistor 56 across which a voltage is developed which is a function of current flow through the photoelectric device and hence of light input to the photoelectric device. The voltage from resistor 56 controls the output of an amplifier or other controllable device indicated at 58 which output is an electronic signal which is a function of the light input to the photoelectric cell 48. The circuit shown in FIG. 2 is illustrative of circuit means for deriving from the amount of light reflected from the phase interface surface a signal which is a function of the rate of rise and fall of liquid in the pumping chamber 40 and hence of the pumping rate (flow) into and out of the chamber 40 and any of thousands of signal producing circuits may be used, as well as using the signal directly from the photoelectric device, to indicate pumping rate and/or to control pumping rate and thus flow through conduit 30 as described below.

Pumping chamber 40 is defined by a chamber wall 60 which encloses the end of a Brewster prism 62. All of the aforesaid components are constructed and configured to define a gas-tight gas and liquid handling system which prevents contact of the reagent with the ambient atmosphere. Suitable temperature controlling devices and/or enclosures may be provided to assure constant volumes and provide physical protection of the gas and liquid handling system, but these are not essential to or part of the present invention.

Light reflected from a dielectric surface is always partially polarized and, at a particular angle of incidence, is completely polarized. The angle of incidence of light on a transparent medium, e.g., glass or water, at which the reflected light is completely polarized is referred to as Brewster's angle (Sir David Brewster, 1781–1868). Using Snell's law of refraction, Brewster's angle can be correlated with $\eta$, the index of refraction of the medium. Brewster's angle is $\theta_{90}$ and then tan $\theta_{\pi}=\eta_2/\eta_1$. At this polarizing angle, the reflected and refracted rays are 90° apart. For glass, which has an index of refraction of about 1.5, the reflected ray is completely polarized when light is incident at 57°. The remainder of the light, the refracted ray, is partially polarized. The index of refraction $\eta$ of and gases generally is about 1.000 to 1.005, that of air being about 1.003, and the index of refraction of the reagents which are commonly used in the semiconductor industry is about $1.4\pm0.15$.

The end of the optical prism 62, referred to here merely for convenience as a Brewster prism, has one or surfaces tilted at Brewster's angle $\theta_B$ for the gas interface with the prism, the angle reference being the direction of travel of light photons, impinging upon the end from the light source. Brewster prism 62 in the pumping chamber 40 thus defines a phase interface surface at the Brewster angle, the Brewster angle being defined by the index of refraction $\eta$ of the pumping gas or the liquid. The end of the prism 62 may be conical, the angle of the cone surface with respect to the light source being the Brewster angle, or it may have one or more planar surfaces at such angle. The effect of tilting the end at this angle is to substantially eliminate or greatly minimize the reflection of the incident polarized light. The polarized light beam is reflected when the plane of the end of the prism is tilted at Brewster's angle and a gas, e.g. nitrogen, in which $\eta$ is about 1.003, is in contact with the plane. When a fluid, which has a significantly different index of refraction, e.g. $\eta=1.4$, is in contact with the end of the prism, the conditions for Brewster's law are met and substantially all of the light incident on the end planes of the prism is transmitted. The result is a very precise demarcation between the gas and liquid phases. As a consequence, total reflected light is a very precise function of the portion of the end of the prism in contact with the liquid. If a non-polarized light is used, the same result is achieved but the sharpness of the demarcation is somewhat reduced, but not below a very useful level of precision. Ideally, a monochromatic polarized light is desired but certainly is not necessary.

By converting the intensity of reflect light to an electronic signal, using any of the many available photometric devices, an electronic signal which is also a precise function of the portion of the end of the prism in contact with the liquid is obtained.

Referring now to FIG. 1, the operation of the controller according to the present invention is accomplished by securing inlet conduit 33 and delivery conduit 24 to the liquid source or bubbler 10. A source of high pressure gas dispensed from cylinder 22 is admitted through regulator 20 into conduit 31 and at the same time through conduit 32 and branch conduit 33. At the startup, valves 16 and 28 are closed and valve 34 is set to vent through restrictor 35. The controller 50 is set to cause valve 16 to open forcing liquid 12 from reservoir 10 through conduit 24, valve 16 and conduit 14 into the pumping chamber 40. Gas in pumping chamber 40 will vent through conduit 36, valve 34 and restrictor 35. When the detector 42 indicates that liquid has risen to approximately the top of chamber 40 as indicated by letter a, controller 50 causes valve 28 to open, thus delivering the liquid 12 through conduit 26 and valve 28 into the delivery conduit 30, and at the same time controller 50 causes valve 16 to close. When valve 16 closes, valve 34 simultaneously switches, closing path to restrictor 35 and opening path from conduit 36 to conduit 32, so that the source pressure forces the liquid from the chamber 40 through conduit 26 and valve 28 into the delivery conduit 30. When the level of gas carrying liquid in chamber 40 reaches a level indicated by letter b, valve 34 switches, closing path from conduit 36 to conduit 32, and opening path from conduit 36 to restrictor 35. Valve 16 opens and the chamber 40 again is filled and the cycle repeated. Thus, with the system of the present invention a smooth flow of liquid is delivered to pipe 30 for delivery to the point of use. In normal operation the cylinder pressure is set at a constant 15 psig as indicated by the gauges associated with the regulator 20. Valve 34, being a three-way valve, has associated with it a restrictor 35 to permit continuous venting of the valve.

Thus, the device of the present invention acts as a gas piston flow controller by ultimately pumping liquid into and out of chamber 40 to assure a smooth continuous flow in the delivery conduit 30.

The volume defined by the space between the walls of the pumping chamber and the end of the prism is defined by the geometry of the pumping chamber walls and the prism and can be calculated from the known dimensions of the pumping chamber components and/or very precisely determined using standard volumetric measuring devices. Likewise, the volume of liquid in the pumping chamber at any given liquid level can be determined either through geometric calculations or empirically using standard volumetric instruments.

Knowing the volume and the height-volume functions of the pumping chamber, it is a relatively simple matter to define a volume to signal relationship, either by defined function or empirical calibration curve, which precisely relates the strength of the signal to the volume of liquid in the pumping chamber and also to any change in such volume.

Figure 3:
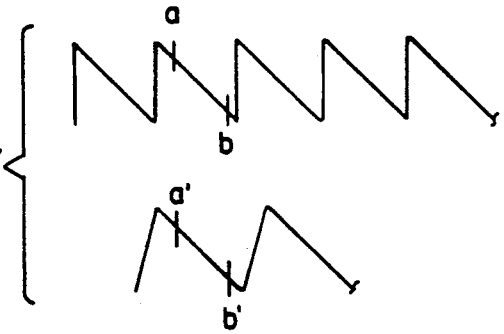
FIG. 3 is a graphical representation of the wave-form of two typical signals used as an aid in describing the operation of the invention, magnitude of the signal being depicted in Cartesian coordinates, the ordinate representing magnitude and the abscissa representing time, with respect to which any desired system of electrical and time units may be used.

Referring now to FIG. 3, in connection with the foregoing discussion, the operation of the pump or flow controller can be further described. Assume, for purposes of discussion, that the two saw-tooth curves represents the strength of the electronic signal; i.e., the voltage or current, etc., of the signal as a function of time. Since the difference in the volume of liquid in the pumping chamber at a level corresponding to a signal of strength a as compared with the level corresponding to a signal of strength b is precisely known, the pumping rate is then a function of the time for the volume to go from the level corresponding to a to the level corresponding to b. This time, of course, can be measured with great precision and can be used simply as an indicator of flow rate controlled by other means or used as a control signal to maintain a constant pumping rate or a variable rate according to any desired parameter. Relative pumping rates between the pumping regime depicted in the upper curve and the regime depicted in the lower curve of FIG. 3 are easily determined using the time differential from 1 to b in the upper curve of FIG. 3 as compared with the time differential from a' to b' in the lower curve.

Figure 4:
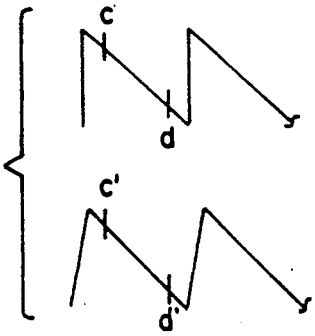
FIG. 4 is also a graphical representation of the wave-form of two typical signals used as an aid in describing the operation of the invention, magnitude of the signal being depicted in Cartesian coordinates, the ordinate representing magnitude and the abscissa representing time, with respect to which any desired system of electrical and time units may be used.

Referring the FIG. 4 now, it will also be apparent that the rate of pumping can be measured and/or controlled using the magnitude of the signal as the controlling factor and operating between any two levels in the pumping chamber. As depicted in FIG. 4, the time between c and d is equal to the time between c' and d' is the same, but the volume differential between c and d between c' and d' is very different. Obviously, a combined function of time and signal strength can be used as a measurement of the pumping rate and/or for controlling the pumping rate.

Another way of viewing the measuring and/or controlling signal is to use the slope of the line, at a given minimum and maximum level in the pumping chamber, as the criterion for measurement and/or control. The slope of the line may be considered to represent rate, i.e., V/T where V is the volume of liquid pumped and T is the time, both in such units as may be convenient, e.g., cc/min, etc. By adjusting the slope of the line, the rate of pumping is adjusted. By using a constant slope and adjusting the valves, pressure, etc., to maintain that slope, a constant pumping rate is maintained.

Materials of construction are not important in the operation of the invention, so long as the system performs the function in the manner described. In the handling of ultra-pure reagents, such as, for example, semiconductor dopants and film-forming materials, however, the nature of the reagent and/or the purity requirements may contain the use of particular materials. In such applications, the conduits and devices contacted by the reagent may be fabricated of quartz or of particular glasses which do not contaminate the reagent and which are non-reactive. Inert polymers, such as polytetrafluorethylene (Teflon®), may also be used in some instances. In one embodiment, for handling ultra-pure dopants which are highly reactive, the reagent conduits, pumping chamber and throttle valve may be made of quartz, insofar as those portions of which are contacted by the reagent. A constant, fixed orifice capillary tube formed of quartz may, for example, be used as the throttle valve and input pressure may be varied to change flow. A mechanical needle-type valve in which the conduit and needle are formed of quartz may also be used, with, for example, a Teflon® seal between moving parts. The Brewster prism 62 may, typically, be formed of quartz or glass which does not react with or contaminate the reagent. In other uses, stainless steel or other metals and materials may be used for the conduit system and walls of the pumping chamber. It should also be noted that while it is preferred, as depicted, to measure the light reflected from the phase interface between the prism and the gas or liquid in the pumping chamber directly, i.e., through the prism, the transmitted light could be measured. Measurement of the transmitted light is, of course, simply another way of measuring reflected light, by difference rather than directly.

Several specific embodiments of the present invention which differ in detail but not in principle may be constructed substantially in the manner described, one such embodiment comprising a chamber formed of a suitably chemical resistant material, stainless steel, titanium, or quartz, for example, depending on the reagents in use. Such a chamber may be formed by constructing, as part of the chamber, a conical quartz symmetrically about a mathematical but imaginary axis housing having conical walls disposed at about 57° with respect to the axis and having a maximum diameter of 4 cm. (It is noted here that the chamber need not be in any particular form, as there are no critical angles vis-a-vis the chamber. The use of a conical chamber is described for simplicity only. A conical end is formed and polished on the end of a 3 cm diameter quartz rod at 57°. The chamber has a gas input conduit and a liquid input-output conduit in fluid communication therewith. These conduits may be arranged substantially as shown in FIG. 1, but no particular configuration is required. Indeed, as previously described, no gas input would be required if the liquid is pumped against the pressure of trapped gas in the chamber; however, it is desirable to avoid handling of very high purity reagents to the extend possible and, therefore, the pumping action is most conveniently performed on a gas phase which does not enter into the ultimate reaction. Also, separate liquid input and output conduits may be used, but are not necessary. The conical end of the quartz rod is positioned centrally in the conical portion of the chamber, and the chamber is sealed, by fusing the quartz components or using appropriately inert fittings of any desired type. The first and second levels may be selected anywhere along the prism. For example, if the prism is positioned symmetrically in the center of the conical portion of the chamber structure, and the first level is ¼ cm from the tip of the prism and the second level is ½ cm from the tip and the liquid is pumped between these levels, the pumping rate will be approximately 2.3 $cm^3$ per pumping stroke. (The precise volume per stroke may be calculated if the dimensions of the chamber are precisely known; however, very precise stroke volumes may be determined by precision empirical measurement of liquid output.) Since the stroke volume is precisely known, the rate of flow through the chamber can be controlled or measured very precisely by controlling or measuring the rate movement of liquid between the first and second levels, and may be read or displayed as pumping or flow rate using a calibration curve or algorithm, for example, to convert time to volume. If a very constant flow rate is desired, the liquid from the pump just described may be pumped against a large gas ballast tank and permitted to flow through an orifice of known size. Since the pressure in the ballast will remain substantially constant, the pressure on the liquid against the orifice will also be constant; hence, the flow rate will be constant. Other flow-leveling devices may also be used to filter out the pulsing of flow which results from the pump.

If a very much lower rate is desired, the chamber may be defined by an optical flat Brewster angle prism on the end of a quartz rod and another optical flat quartz sheet placed a small, but precise, distance from the prism optical flat, with edges of these optical flats sealed together. If, for example, a pair of optical flats 2 cm square are fused or sealed together on the edges and are spaced from each other by 1 mm, and the first and second levels are 1 cm apart, then the stroke volume will be (2 cm) x (1 mm)$=2\times10^{-3}$ $cm^3$ per stroke, permitting very precise control or measurement of very small volumes of liquid throughput.

It will be apparent from the principles discussed above and the examples that the pumping or measuring device of this invention is capable of adaptation to minute or substantial flow rate systems.

Thus, it will be apparent that the invention may be constructed using any of a virtually infinite number of devices and may be constructed in a great many ways so long as it performs the function in the manner described by using a chamber of known volume to receive the liquid being controlled and using liquid level detectors to determine the upper and lower levels of the liquid to effect smooth flow or pumping.

What is claimed is:

1. A gas piston flow controller comprising in combination:

(a) a closed chamber having a known volume;

(b) first means to controllably introduce pressurized gas into said chamber;

(c) second means to controllably introduce liquid into said chamber;

(d) third means to controllably withdraw a stream of said liquid for delivery to a point of use;

(e) means to detect predetermined upper and lower levels of liquid retained in said chamber; and (f) a controller adapted to control said first, second and third means so that when said means to detect said levels detects said liquid at said upper level, said second means shuts off flow of said stream of liquid to said chamber, when said means to detect said level detects said liquid at said lower level, said first means shuts off flow of said pressurized gas to said chamber while said second means opens to reestablish flow of said liquid to said chamber and said controller permits flow through said third means only when liquid is present in said chamber and wherein said first, second and third means are controlled positive shut-off valves.

2. An apparatus according to claim 1 wherein said first, second and third means are electrically controlled positive shut-off valves.

3. An apparatus according to claim 1 wherein said means to detect predetermined levels of liquid includes a phase interface surface at the Brewster angle defined by the index of refraction $\eta$ of the liquid; a source of light to be directed toward said phase interface surface; and means for detecting light reflected from said phase interface surface at the predetermined upper and lower levels of liquid in said chamber and means including means to generate one signal to activate said controller when liquid is detected at said upper level and means to generate another signal when the absence of liquid is detected in said lower level.

4. A gas piston liquid flow controller comprising:

(a) a pumping chamber having input and output means;

(b) means for supplying the liquid to be pumped to the input of the pumping chamber;

(c) means for cyclically varying the volume of a pumping gas in the pumping chamber for pumping the liquid;

(d) a Brewster prism in the pumping chamber defining a phase interface surface at the Brewster angle defined by the index of refraction $\eta$ of the pumping gas or the liquid;

(e) a light source for directing a beam of light toward the phase interface surface;

(f) a photoelectric sensor for measuring the light reflected from the phase interface surface; and (g) circuit means for deriving from the amount of light reflected from the phase interface surface a signal which is a function of the rate of rise and fall of liquid in the pumping chamber and, hence, of the pumping rate of the chamber.

5. The gas piston liquid flow controller of claim 4 further comprising flow throttling means in fluid communication with the output of the pumping chamber providing a predetermined flow orifice for the pumped liquid.

6. A method for controlling the flow of a liquid comprising the steps of:

(a) forming in a pumping chamber a gas-liquid interface of the liquid and a gas against the surface of a Brewster angle optical device, the Brewster's angle being a function of the index of refraction $\eta$ of the liquid or the gas;

(b) moving the gas-liquid interface cyclically between predetermined portions of said surface by varying the volume of said gas in the pumping chamber;

(c) measuring the light reflected from said surface; and (d) controlling the movement of said gas-liquid interface as a function of the measured light reflected from said surface.

* * * * *